United States Patent [19]

Morrison

[11] 3,956,782

[45] May 18, 1976

[54] CONTOUR MATTRESS COVER

[75] Inventor: Robert D. Morrison, Worthington, Ohio

[73] Assignee: Morrison Medical Products Company, Columbus, Ohio

[22] Filed: Sept. 19, 1974

[21] Appl. No.: 507,338

[52] U.S. Cl. ..... 206/390; 5/334 C; 5/317 R

[51] Int. Cl.[2] ..... A47C 21/00; A41D 13/04; A47G 9/00

[58] Field of Search..... 5/317, 334, 334 R, 334 C, 5/335, 317 R; 2/49 R, 50, DIG. 7, 111; 206/58

[56] References Cited

UNITED STATES PATENTS

| | | | |
|---|---|---|---|
| 2,224,746 | 12/1940 | Richstein | 2/49 R |
| 3,001,646 | 9/1961 | Cooper | 2/49 R |
| 3,229,875 | 1/1966 | Stoller | 2/49 R |
| 3,332,547 | 7/1967 | Rowe et al. | 2/49 R |
| 3,380,086 | 4/1968 | McCurry | 5/334 R |
| 3,388,406 | 6/1968 | Scrivener | 5/334 R |
| 3,583,558 | 6/1971 | Davis | 2/49 R |
| 3,641,600 | 2/1972 | Oats | 5/334 C |
| 3,646,624 | 3/1972 | Zipf | 5/334 R |
| 3,739,408 | 6/1973 | Pagels | 5/334 C |

*Primary Examiner*—Casmir A. Nunberg
*Assistant Examiner*—Andrew M. Calvert
*Attorney, Agent, or Firm*—Frank H. Foster

[57] ABSTRACT

A sheet of flexible material is folded and seamed into a contour mattress cover which lies flat for storage and may be formed as a continuous ribbon of detachable, end to end connected covers wound into a roll or may be individually interleafed in a pop up arrangement in a box or other dispenser. A flexible sheet comprising a fluid impervious, thermoplastic foundation layer laminated to an absorbent layer has its relatively longer opposite sides folded back onto its non-absorbent surface to form inwardly opening pockets. Longitudinally spaced, heat sealed, transverse seams, which are shaped to correspond to the opposite ends of the mattress, connect interfacing layers of the folded sheet for closing the ends of the pockets.

1 Claim, 6 Drawing Figures

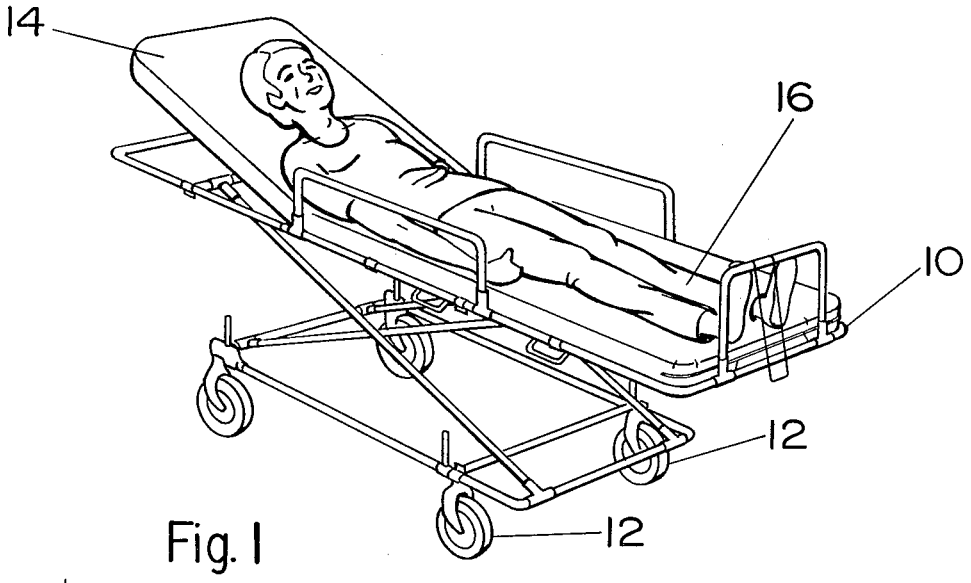
Fig. 1
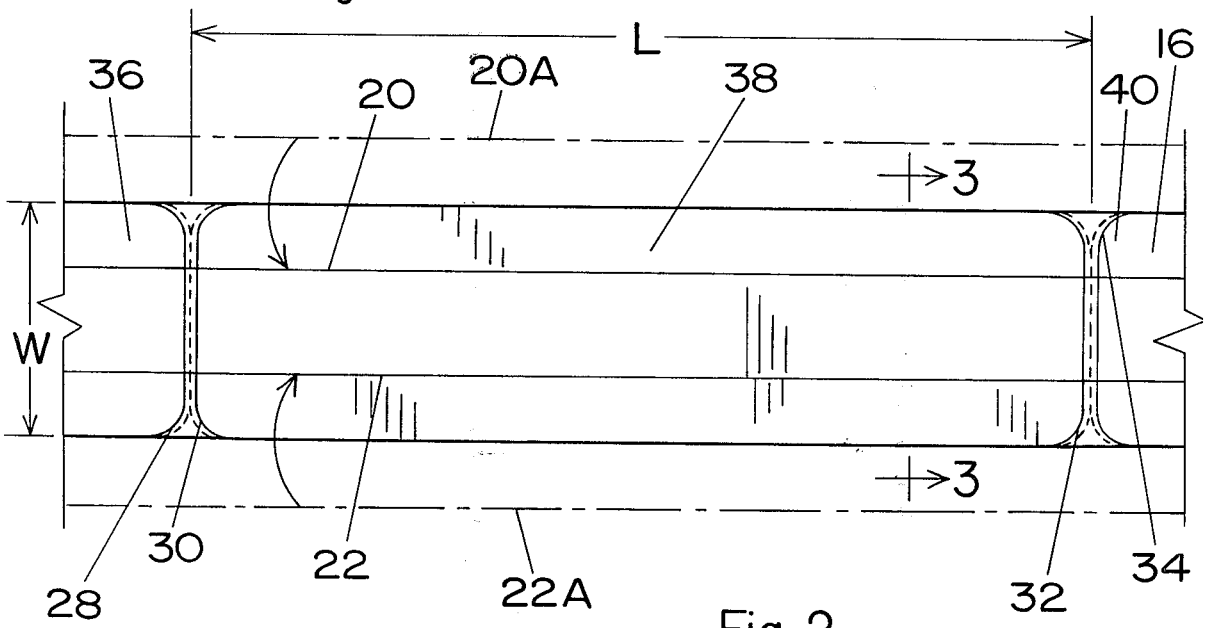
Fig. 2
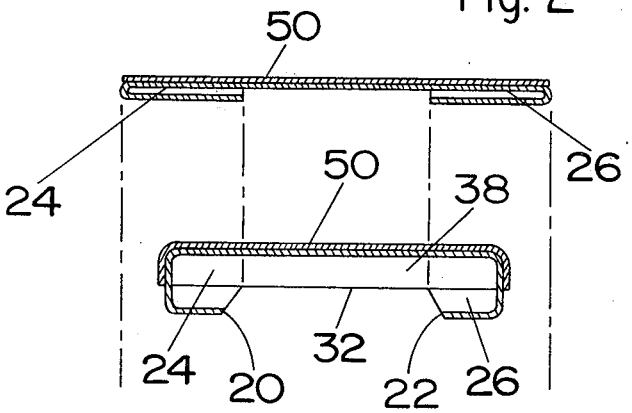
Fig. 3
Fig. 4

CONTOUR MATTRESS COVER

BACKGROUND OF THE INVENTION

This invention relates generally to a contoured mattress cover for bed clothing. More particularly, the invention relates to a disposable, fluid impermeable, absorbent, protective cover for use on mattresses, pads and pushions especially those of the type commonly used in ambulances and hospitals.

Stretchers, litters, and cots are standard medical emergency equipment commonly available in ambulances or emergency medical units. Such equipment ordinarily has an associated mattress or pad having a permanent and durable exterior surface such as simulated leather. In order to maintain cleanliness, the conventional practice is to lay a clean muslin sheet over the mattress and sometimes to tuck the side of the muslin sheet beneath the mattress intermediate the mattress and its supporting surface.

There are several problems which are encountered with this conventional practice. Often the ends of the mattress are exposed and consequently may be soiled and thereafter become a source of contaminants and injurious organisms. Occasionally, such sheets are not tucked beneath the mattress and instead are permitted to drape toward the floor. In this situation, they are liable to be caught in any wheels associated with the apparatus on which they are used and are also subject to being displaced sideways and thereby expose more of the mattress when a patient is slid onto the mattress.

Another disadvantage of such muslin sheets is that, while they are absorbent, they are also pervious to fluid materials. Consequently, injurious organisms or toxic materials may be absorbed through the sheet and deposited on the permanent mattress cover. Later, such materials may migrate or be carried by a fluid through an initially clean muslin sheet into contact with a subsequent patient.

Still another difficulty with the use of conventional muslin sheets is that they are expensive. They are expensive to purchase and they require expensive laundering after each use. Additionally, a hospital is required to own approximately six muslin sheets for each sheet in current use because those sheets not in use are at various stages in the laundering process. Furthermore, substantial building space is consumed in storing as well as processing so many sheets. Storage space is of course at a premium and presents an especially acute problem in an ambulance.

Yet another concern with the present conventional use of muslin sheets if the time required to change the bed clothing of a hospital bed or of a mattress on a patient transport apparatus. Because of the manner in which a hospital bed is made or a muslin sheet is placed on a litter a significant cumulative amount of human labor is required.

Another problem encountered in this field is the disposal of used, dirty or soiled sheets. This is a particular difficulty in large metropolitan areas where ambulances may leave their central station and be posted in positions distributed around the area for long periods. In this type of operation soiled sheets present a storage problem pending their return to the central station.

SUMMARY OF THE INVENTION

It is therefore an object of the invention to provide a contour sheet which may be more economically and efficiently stored in a minimum of space and yet be readily and conveniently accessible for quick installation upon a mattress.

Another object of the invention is to provide a contour sheet which may be made so rapidly and of such inexpensive materials that it may be discarded after a single use.

Still another object of the invention is to provide a contour sheet which may be installed more quickly than conventional sheets and yet more completely covers the mattress so that very little of it is exposed.

Another object of the present invention is to provide a contour sheet which utilizes less material than other contour sheets and which can be made of impermeable or permeable, breathable materials for home or domestic use as well as for use in the medical field.

Yet, another object of the present invention is to provide a contour sheet which is both impermeable to fluid and yet absorbent.

A further object of the present invention is to provide a contour sheet which tightly fits around the mattress and is locked in place so that it can not slip or slide when a patient is positioned on it and so that it does not interfere with the mechanical structures of the mattress supporting unit.

The present invention involves a contour mattress cover comprising a flexible sheet having its relatively longer opposite sides folded back on the same surface of itself to form inwardly opening pockets and having longitudinally spaced transverse seams connecting the interfacing layers of the folded sheet for closing the ends of the pockets. The invention also contemplates a method for forming a continuous ribbon of a flexible material into a contour mattress cover. The method comprises: (a) feeding the ribbon through a folding station and a seaming station; (b) continuously guiding the opposite edges of the ribbon into a fold back onto the same surface of itself at the folding station; and (c) forming transverse seams at longitudinally spaced intervals along the ribbon to connect the interfacing layers of the sheet.

Further objects and features of the invention will be apparent from the following specification and claims when considered in connection with the accompanying drawings illustrating the preferred embodiment of the invention.

DESCRIPTION OF THE DRAWINGS

FIG. 1 is a view in perspective of an adjustable height cot having a contour mattress cover embodying the present invention.

FIG. 2 is a plan view of a segment of a continuous ribbon of end to end detachably connected mattress covers embodying the present invention.

FIG. 3 is a view in vertical section taken substantially along the lines 3—3 of FIG. 2.

FIG. 4 is a view in vertical section taken substantially along the lines 4—4 of FIG. 5 and illustrating a mattress cover such as illustrated in FIG. 2 in an installed configuration.

Figure 5:
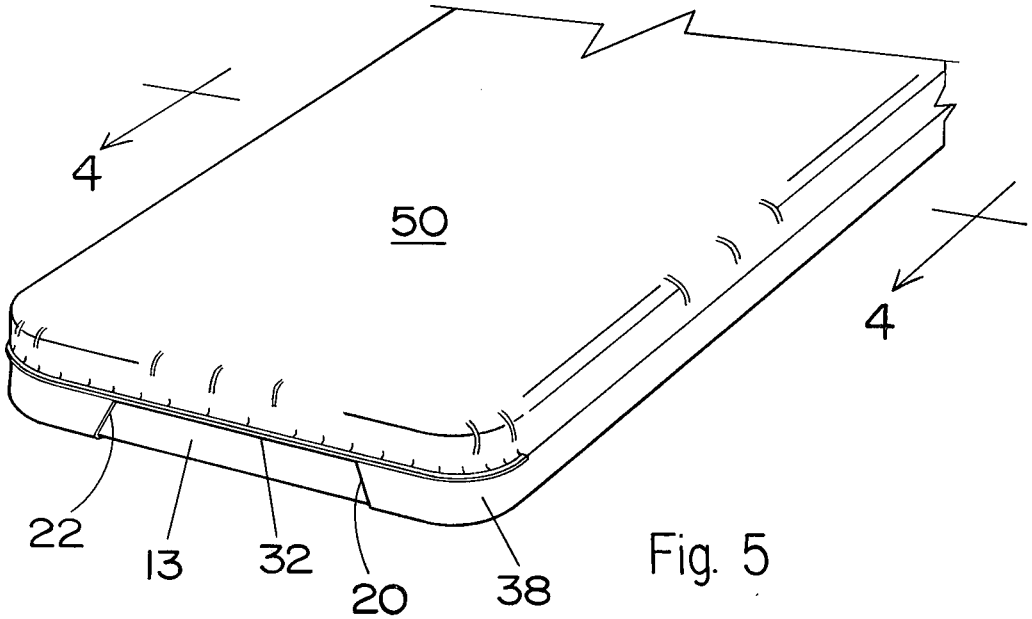
FIG. 5 is a view in perspective illustrating in detail a portion of a mattress covered by a preferred embodiment of the invention.

In describing the preferred embodiment of the invention illustrated in the drawings, specific terminology will be resorted to for the sake of clarity. However, it is not intended to be limited to the specific terms so selected, and it is to be understood that each specific term includes all technical equivalents which operate in a similar manner to accomplish a similar purpose. In addition, some dimensions where appropriate are exaggerated to facilitate illustration of the invention.

DETAILED DESCRIPTION

FIG. 1 illustrates an adjustable height cot 10 having caster wheel 12 and a covered mattress 14 for supporting a patient 16 and embodying the present invention.

FIGS. 2 and 3 illustrate a mattress cover embodying the present invention and shown in an uninstalled configuration. The mattress cover is formed from a segment of a continuous ribbon-like sheet 18 of a flexible thermoplastic material such as polyethylene. The relatively longer opposite sides 20 and 22 of this sheet 18 have been folded from their original outstretched positions at 20A and 22A back onto the same surface of the sheet 18 to form inwardly open pockets 24 and 26.

A plurality of longitudinally spaced, transverse seams 28, 30, 32 and 34 connect the interfacing layers of the sheet 18 for closing the ends of these pockets. Preferably, with a thermoplastic sheet material, the seams are formed by conventional heat sealing or heat welding techniques by which the materials are compressed against a heated die. However, it should be understood that many other flexible sheet materials both previous and impervious as well as woven fabrics and nonwoven materials and so forth may be utilized in forming contour mattress covers embodying the present invention. It should also be recognized that various other means for connecting layers and making seams may also be used. Such methods would include adhesive bonding, sewing and stitching, and other means which have heretofore been suggested for adhering or connecting two layers of flexible sheet material.

The preferred embodiment of the invention utilizes the continuous ribbon-like sheet illustrated in FIGS. 2 and 3 to form a series of end to end connected contour mattress covers. For example, in FIG. 2 are shown a portion of a cover 36, an entire mattress cover 38 and a portion of still another adjoining mattress cover 40.

In order to form such a series of connected mattress covers on a ribbon, the seams are alternately separated by a short, perforated segment and a relatively longer segment which is slightly longer than the length of a mattress. The perforated segment facilitates separation of the individual mattress covers from the continuous ribbon. For example, and most advantageously, the perforations adjoin and are laterally coextensive with the heat sealed seams. These aligned perforations of the relatively shorter segments are formed on the sides of the seams which are opposite the relatively long segment which forms the bulk of the mattress cover.

Most desirably, the transverse seams are shaped to correspond to the shape of the ends of the mattress of which they are to be used. For example, the mattress of FIG. 1 has circularly rounded corners and consequently the seams are illustrated with similar circularly rounded corners. Mattresses with corners of other shapes would advantageously utilize contour mattress covers with correspondingly shaped end seams. For example, a mattress cover with sharp rectangular corners might utilize seams which are spaced straight parallel lines alternately separated by a line of perforations and perpendicular to the relatively long sides of the sheet.

The distance between the seams at opposite ends of the relatively long segment which forms the major portion of the cover is approximately equal to the length of the mattress. More particularly, however, it is most desirable that the length L of the folded mattress cover be substantially equal to the sum of the length and the thickness of the selected mattress. It is similarly desirable that the width W of the folded mattress (i.e. the distance between the creases) be substantially equal to the sum of the width and the thickness of the mattress. By constructing the mattress cover with these preferred dimensions, the cover can be tightly and snugly fit over the mattress and positioned as illustrated in FIGS. 4 and 5 so that the seamed ends of the mattress cover extend partly around the ends of the mattress and are positioned approximately intermediately between the top and the bottom surface of the mattress 13.

Although polyethylene is advantageously used because it is impermeable to fluids and is slightly elastic, it suffers the disadvantage that it is adherent and tends to stick to moist objects such as human skin. It also may produce some discomfort since it permits no ventilation. It has therefore been found desirable to heat seal, adhesively bond or otherwise attach a layer of absorbent material 50 to the central exterior surface of the underlying polyethylene sheet to form a laminate. This absorbent material layer 50, which may, for example be absorbent paper, is attached to the surface of the sheet 18 opposite the surface on which the sheet is folded and forms an absorbent facing.

The use of this fluid impermeable yet absorbent laminate provides a barrier which is impermeable to liquid or gas so that contaminants can not move in either direction through the material. Consequently, staining and contamination of the underlying mattress is prevented and any contaminants on the mattress from other sources are prevented from being carried outwardly through the contour mattress cover to the patient.

Mattress covers embodying the present invention may be formed from a continuous ribbon of flexible material by feeding the ribbon through a folding station and a seaming station. The edges of the continuous ribbon may be guided at the folding station into a fold back onto the same surface of itself. At a subsequent seaming station the transverse seams are periodically formed at longitudinally spaced intervals along the ribbon. These seams can be formed by intermittently stopping the advance of the ribbon through the stations while a seam is synchronously formed. Alternatively, the seams may be formed by cooperating dies formed on mating cylindrical rolls. Structures capable of performing these operations are not illustrated because they are known in the art.

Figure 6:
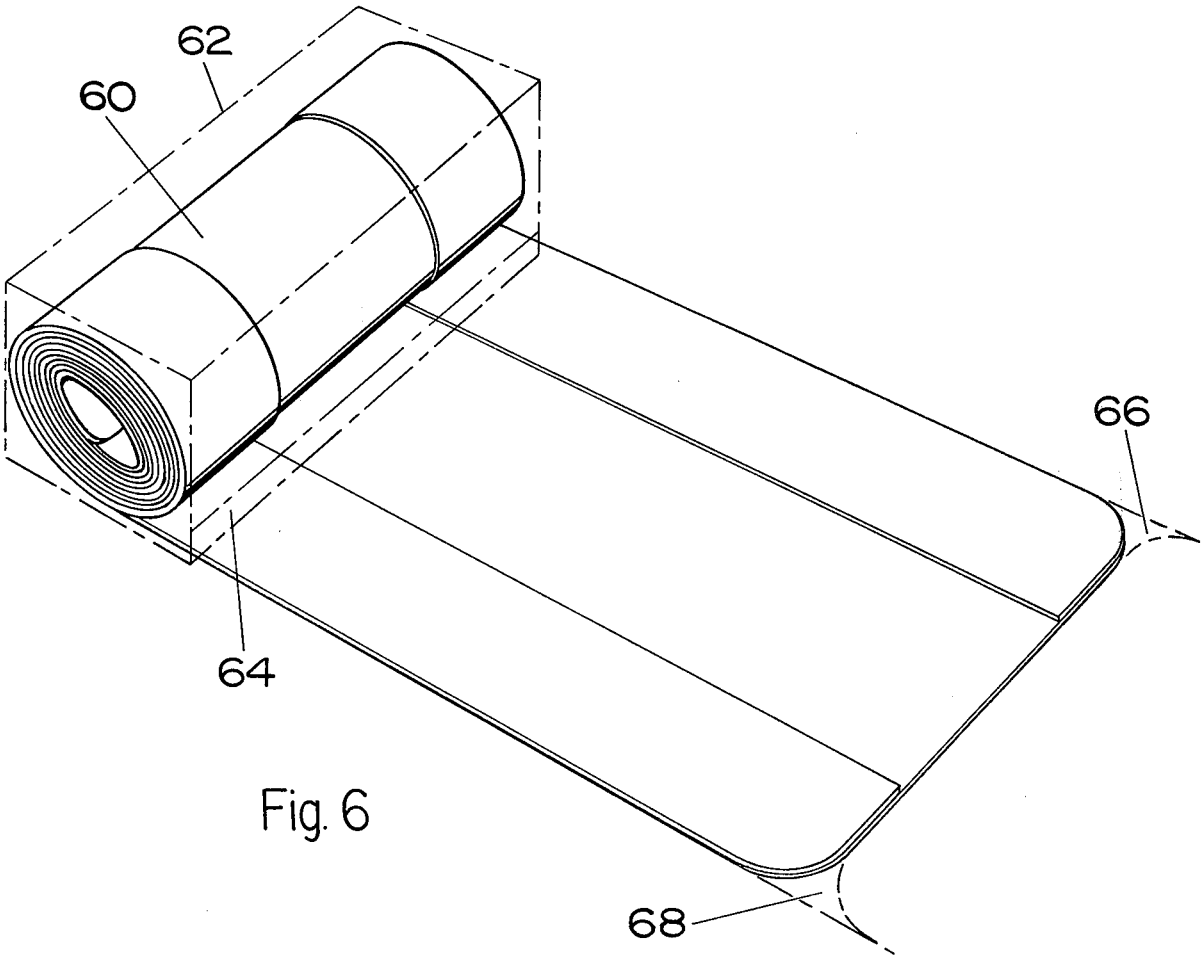
FIG. 6 is a view in perspective illustrating a continuous ribbon-like series of contour sheets wound into a roll and placed in a dispenser and embodying the present invention.

It will be understood that mattress covers embodying the present invention can also be formed in single units on discrete sheets. However, it is preferable to form these mattress covers in a continuous, end to end linked ribbon which is wound into a roll 60 illustrated in FIG. 6. This roll is conveniently positioned in a dispensing carton 62 provided with a slot 64 through which the ribbon is withdrawn. This preferred embodiment of the invention may be utilized by withdrawing enough of the continuous ribbon from the roll to expose a single mattress cover. The mattress cover is then briskly pulled or torn so that separation occurs along the perforations. This will leave the remainder of the roll safely and cleanly in the dispensing container 62. As illustrated in FIG. 6, the separation between contour sheets may occur leaving a rounded corner of the subsequent contour sheet or it may leave pointed excess portions 66 and 68 illustrated in phantom in FIG. 6. These excess portions however, are of no consequence and can be permitted to remain on the subsequent sheet as it is used.

It can now be appreciated that the present invention satisfies the objects of the invention stated above. In particular, it can be seen that the space occupied by the dispensing container 62 may be as small as one/half a cubic foot while the space occupies by six folded muslin sheets may be on the order of eight cubic feet. This space savings makes additional space available for other purposes in an ambulance or hospital.

Instead of requiring the lengthy installation time required for conventional sheets, the contour sheet of the present invention is installed by merely inserting one end of the mattress into the ends of the pockets near one end seam of the sheet, pulling the sheet tightly over the top of the mattress and then pulling the opposite end of the sheet down and the pocket ends around the opposite corners of the mattress. The savings in time may represent a reduction from approximately three minutes to approximately twenty seconds representing accumulatively a considerable savings in hourly wages.

One advantage of utilizing a material such as polyethylene is that it allows some tight stretching of the contour sheet so that a cover embodying the present invention may be drawn taut over the mattress. It remains taut and therefore is of neat appearance and can not interfere with or get caught in other mechanisms. Additionally the entire sides and most of the end portions of the mattress are completely covered.

It might also be noted that in hospital carts it is common to fasten the underside of a mattress to the cart by means of straps in order to retain the mattress on the sheet and prevent slippage. The mattress cover embodying the present invention does not interfere with this connection because of the open space it provides along the central underside of the mattress.

Embodiments of the present invention are also suitable for home or domestic use particularly when manufactured of a permeable material which permits ventilation. Suitable permeable materials would include for example woven fabrics as well as resin films which have been perforated. Such embodiments would, for example, alleviate a housewife's burdens while vacationing at a summer cottage or for house guests.

Individual or discrete sheets embodying the present invention can alternatively be stored in an interleafed arrangement in a box or dispenser so that when one is withdrawn the next one readily and conveniently available. Such packaging has heretofore been done for paper tissues and hand towels.

Finally, it should be noted that an equivalent structure embodying the present invention can be formed by sewing together individual sheets to form an embodiment of the present invention. For example, the folded overlaid portions of the present contour sheet could be formed of separate sheets or material sewn to the unfolded portion along the edges of the mattress cover. This would represent the sewing together of three sheets of material to form an equivalent single sheet.

The most outstanding feature of the present invention is that it permits an entirely flat sheet of material to be very simply formed into a contour sheet which lies entirely flat for storage and yet tightly contours about a mattress.

It is to be understood that while the detailed drawings and specific examples given describe preferred embodiments of the invention, they are for the purpose of illustration only, that the apparatus of the invention is not limited to the precise details and conditions disclosed and that various changes may be made therein without departing from the spirit of the invention which is defined by the following claims.

What is claimed is:

1. A plurality of end to end detachable contour mattress covers comprising: a flexible ribbon sheet having its opposite sides folded back onto the same surface of itself and having longitudinally spaced transverse seams connecting interfacing layers of said sheet to form and close the ends of a plurality of inwardly opening pockets, said transverse seams being alternately separated by a relatively short perforated segment and a relatively long segment, said seams further being rounded in correspondence with the shape of the ends of a selected mattress and wherein the length of said long segment is substantially equal to the sum of the length and the thickness of a selected mattress and wherein the width of said folded sheet is substantially equal to the sum of the width and the thickness of said mattress.

* * * * *